US006125471A

United States Patent [19]

Gupta et al.

[11] Patent Number: 6,125,471

[45] **Date of Patent: *Oct. 3, 2000**

[54] DISPOSABLE BIB HAVING AN EXTENSIBLE NECK OPENING

[75] Inventors: Amit Gupta; Patricia L. Lampson, both of Cincinnati, Ohio

[73] Assignee: The Procter & Gamble Company, Cincinnati, Ohio

[ * ] Notice: This patent is subject to a terminal disclaimer.

[21] Appl. No.: 09/060,133

[22] Filed: Apr. 14, 1998

[51] Int. Cl.[7] ..... A41B 13/00; A41B 13/10

[52] U.S. Cl. ..... 2/49.1; 2/52

[58] Field of Search ..... 2/46, 48, 49.1, 2/49.2, 49.3, 49.5, 50, 51, 52, 174, 104, 105, 106, 113, 114, 115, 75, 80, 83, 69, 695

[56] References Cited

U.S. PATENT DOCUMENTS

| | | | |
|---|---|---|---|
| 3,286,279 | 11/1966 | Brown | 2/19 |
| 3,329,969 | 7/1967 | Faber et al. | 2/49 |
| 3,608,092 | 9/1971 | Taranto | 2/49 R |
| 3,654,629 | 4/1972 | Crisman et al. | 2/49 |
| 3,916,447 | 11/1975 | Thompson | 2/46 |
| 3,979,776 | 9/1976 | Gruenwald | 2/49 R |
| 4,107,364 | 8/1978 | Sisson | 428/196 |
| 4,186,443 | 2/1980 | Britzman | 2/49 R |
| 4,191,609 | 3/1980 | Trokhan | 162/113 |
| 4,416,025 | 11/1983 | Moret et al. | 2/49 R |
| 4,441,212 | 4/1984 | Ahr et al. | 2/49 R |
| 4,445,231 | 5/1984 | Noel | 2/49 R |
| 4,495,658 | 1/1985 | Moret et al. | 2/49 R |
| 4,523,333 | 6/1985 | Spangler | 2/49 R |
| 4,523,334 | 6/1985 | Lavash | 2/49 R |
| 4,529,480 | 7/1985 | Trokhan | 162/109 |
| 4,637,859 | 1/1987 | Trokhan | 162/109 |
| 4,646,365 | 3/1987 | Suprise et al. | 2/49 R |
| 4,797,952 | 1/1989 | Petrini | 2/49 R |
| 4,834,741 | 5/1989 | Sabee | 604/385.2 |
| 4,846,822 | 7/1989 | Foxman | 603/370 |
| 5,074,013 | 12/1991 | Arnold et al. | 24/713 |
| 5,143,679 | 9/1992 | Weber et al. | 264/288.8 |
| 5,156,793 | 10/1992 | Buell et al. | 264/288.8 |
| 5,167,897 | 12/1992 | Weber et al. | 264/288.8 |
| 5,223,096 | 6/1993 | Phan et al. | 162/158 |
| 5,240,562 | 8/1993 | Phan et al. | 162/158 |
| 5,620,430 | 4/1997 | Bamber | 604/385.2 |
| 5,715,542 | 2/1998 | Reinhart, Jr. | 2/49.1 |
| 5,822,792 | 10/1998 | Reinhart | 2/49.1 |
| 5,899,895 | 5/1999 | Robles et al. . | |

*Primary Examiner*—John J. Calvert
*Assistant Examiner*—Shirra L. Jenkins
*Attorney, Agent, or Firm*—Jay A. Krebs; Dave M. Weirich; Steve W. Miller

[57] ABSTRACT

A bib having an area surrounding a neck opening which is permanently elongated to provide extensibility and elasticity of the neck opening. The area surrounding the neck opening can include a strainable network. The network can be formed in a laminate of a paper layer and a plastic film layer. The strainable network can have at least two visually distinct regions. The strainable network can provide a flexible and comfortable fit of the bib against a wearer's neck.

18 Claims, 11 Drawing Sheets

DISPOSABLE BIB HAVING AN EXTENSIBLE NECK OPENING

FIELD OF THE INVENTION

The present invention is related to disposable bibs, and more particularly, to a disposable bib having a laminate structure including a permanently elongated area surrounding a neck opening providing an extensible and elastic opening.

BACKGROUND OF THE INVENTION

Disposable bibs are well known in the art. Such bibs can be provided for use on babies during feeding. Disposable bibs can have a laminate construction comprising multiple layers. For instance, disposable bibs can include an absorbent paper topsheet for receiving spilled food material and a plastic film backsheet for preventing penetration of spilled liquids through the bib and onto the baby's clothing. Other multiple layer bib constructions are also known.

One problem with laminate structures is that such structures can be relatively stiff. A relatively stiff bib can be uncomfortable to a wearer, especially around the neck region. In order to be effective, a bib must fit closely against a wearer's neck in order to prevent spilled or dribbled food and liquid from running through the neck opening onto the wearer's clothing. Stiff laminate structures have stiff edges which are relatively sharp. A neck opening with sharp edges can cause discomfort to a wearer particularly when the bib is tightly drawn around a wearer's neck.

A bib with a neck opening having edges that are relatively flexible can be tightly drawn around the wearer's neck without causing discomfort. Others have produced such a flexible neck opening by way of a gathered or ruffled border comprising a laminate of a nonwoven material and an elastically extensible material. Although such a combination is effective in providing a comfortably tight fit, the added cost of producing the feature makes the application impractical for a disposable bib product.

SUMMARY OF THE INVENTION

The present invention provides a disposable bib comprising a bib body, a pair of shoulder extensions extending from the bib body to provide a generally planar neck opening. The neck opening includes a perimeter and an area surrounding the perimeter which is permanently elongated such that the area is stretched beyond its elastic limit.

The permanent elongation provides an elastic neck opening having circumferential extensibility and radial flexibility. The permanent elongation also provides increased Z-direction bulking of the area for a softer and more comfortable appearance.

In one embodiment, the permanently elongated area comprises a strainable network including at least one first region and at least two second regions. The first region undergoes a substantially molecular level deformation and the second region initially undergoes a substantially geometric deformation when the neck opening is subjected to an applied elongation.

The first region and the second region are visually distinct from one another. The first region is substantially planar while the second region includes a plurality of raised rib-like elements. The orientation of the two regions may take on a number of different arrangements to provide a neck opening having elastic like behavior. A preferred arrangement includes a planar first region extending parallel to the perimeter of the neck opening and raised rib-like elements of the second region positioned orthogonal to the neck opening.

In one embodiment, the laminate comprises a first nonwoven layer and second body facing layer. The second body facing layer can comprise a liquid impervious polymeric film. In this configuration, the raised rib-like elements of the second region extend outwardly from the body facing layer.

In another embodiment, the planar neck opening comprises a front neck portion, a rear neck portion, and a maximum width portion interposed between the front and rear neck portions. An area surrounding the perimeter of the neck opening includes a strainable network oriented to provide elastic like behavior of the neck opening.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
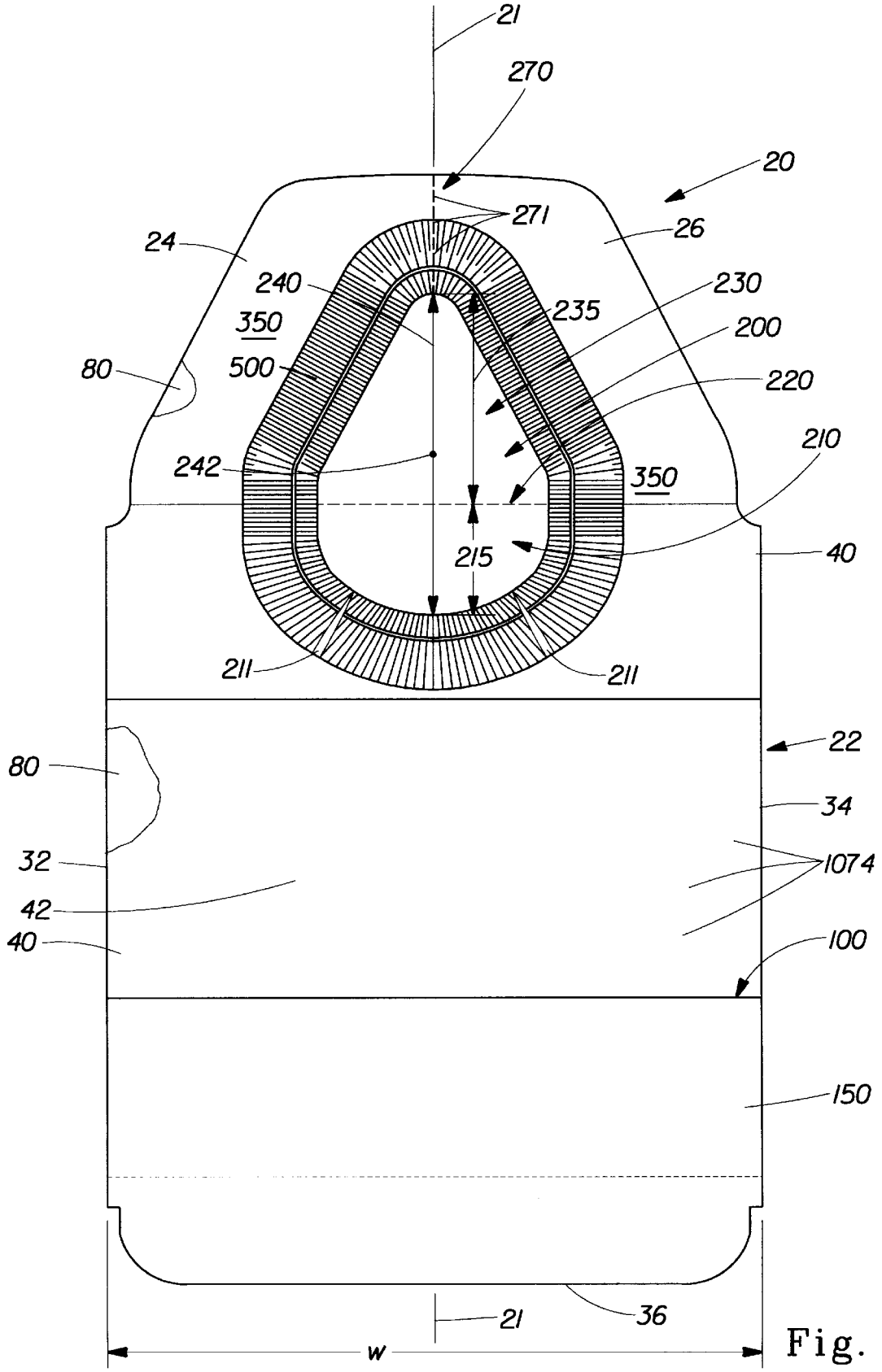
FIG. 1 is a front plan view of the disposable bib of the present invention wherein the bib is supported in a flat, generally planar orientation.

FIGS. 1–4 illustrate a disposable bib 20 according to one embodiment of the present invention. The bib 20 is useful for children or adults to protect clothing from spilled food material.

The present invention provides a disposable bib 20, wherein at least one portion of the bib 20 is permanently elongated to provide improved extensibility of that portion of the bib during subsequently applied loading, such as subsequently applied forces and/or elongations.

In particular, the present invention provides a disposable bib having a neck opening 200 wherein the area 500 surrounding the perimeter of the neck opening is permanently elongated to provide improved extensibility and flexibility of the neck opening resulting in a more comfortable fit.

By "permanently elongated" it is meant that a portion of the bib is stretched beyond its elastic limit, and that upon removal of the mechanism causing the stretching, the portion of the bib retains a deformed configuration having a length which is greater than the corresponding initial length of that portion of the bib prior to stretching.

By "improved extensibility" it is meant that the area surrounding the perimeter of the neck opening which has been previously permanently elongated has the characteristic that it extends (or lengthens) circumferentially, under a subsequently applied load to the neck opening, to a greater degree than the neck opening would extend if the same level of loading were applied to the neck opening of the bib prior to the area surrounding the neck opening being permanently elongated.

In addition to providing extensibility, the permanently elongated portions result in Z-direction bulking of the bib (the Z-direction is perpendicular to the plane of FIG. 1), such that the area surrounding the perimeter of the neck opening has texture in the form of relatively raised regions and relatively recessed regions, such as in the form of corrugations, rib-like elements, peaks and valleys, and the like.

Further, such texture and Z-direction bulking is provided without the use of elastic elements or elastic gathering methods. Such surface texture not only provides an elastic fit, but can also be useful in creating a perception of providing a comfortable fit.

Referring to FIGS. 1–4, the bib 20 comprises a bib body 22 having longitudinally extending sides 32 and 34, a longitudinal length, a longitudinal centerline 21, a laterally extending bottom edge 36, and a lateral width W. The term "longitudinal" refers to an axis or direction measured along the length of the bib body 22, which direction or axis is generally parallel to a line extending from the wearer's head to the wearer's waist, as the bib is worn. The terms "lateral" and "transverse" refer to a direction or axis which is perpendicular to the longitudinal centerline 21, and which is generally parallel to a line extending across the wearer's chest as the bib is worn.

The bib can comprise a laminate of at least two layers. Referring to FIG. 1, the bib body 22 comprises a laminate construction. The laminate includes a first paper layer 40 and a second plastic film layer 80. In FIG. 1, a portion of the paper layer 40 is shown cut away to reveal the plastic film layer 80. The outer surface 42 of the paper layer 40 faces the viewer in FIG. 1. The body facing surface 82 of the second plastic film layer 80 faces the viewer in FIG. 2.

The bib 20 can also comprise a pair of shoulder extensions 24, 26. The shoulder extensions 24, 26 extend from the bib body 22 from their proximal ends to their distal ends to provide a generally planar neck opening 200 when the bib is supported on a flat, horizontal surface.

The generally planar neck opening 200 has a front neck portion 210, a rear neck portion 230, and a maximum width portion 220 disposed intermediate the front neck portion 210 and the rear neck portion 230. The neck opening 200 also has a longitudinal length 240 measured along the longitudinal centerline 21. The maximum width portion 220 of the opening 200 can be a line of maximum width, as shown in FIG. 1, and is disposed between the front neck portion 210 and the rear neck portion 230. The longitudinal length 215 of the front neck opening portion 210 is less than the longitudinal length 235 of the rear neck portion 230. The longitudinal length 235 can be at least 1.5 times the length 215, and more preferably at least 2.0 times the length 215.

The generally planar neck opening 200 is generally symmetric about a longitudinal axis, such as the longitudinal centerline 21, and is generally asymmetric about a lateral axis passing through the midpoint 242 of the longitudinal length 240 when the bib is supported on a flat, horizontal surface. The lateral asymmetry of the neck opening 200 promotes fit about different neck sizes and shapes without slipping, while reducing the tendency of the bib body 22 to gap away from the wearer's chest when the shoulder extensions 24, 26 are overlapped behind the wearer's neck to fasten the bib to the wearer.

A plurality of slits 211 can extend in a generally radial fashion, outwardly from the front portion 210 of the neck opening 200. The slits 211 provide a close yet comfortable fit of the perimeter of the front neck portion against a wearer's neck. The slits 211 allow the resulting petal like portions the bib intermediate the slits 211 to slide over each other as the shoulder extensions 24, 26 are overlapped. The slits thereby help reduce distortion and gapping of the bib body as the neck opening 200 is made to conform to the wearer's neck. Accordingly, the slits cooperate with the shape of the neck opening 200 to improve fit of the bib about the wearer's neck, and reduce distortion and gapping of the bib body as the shoulder extensions, 24, 26 are overlapped to accommodate a particular neck size. Such slits, or bifurcations, are disclosed generally in U.S. Pat. No. 4,416,025 to Moret, which patent is incorporated herein by reference.

Figure 4:
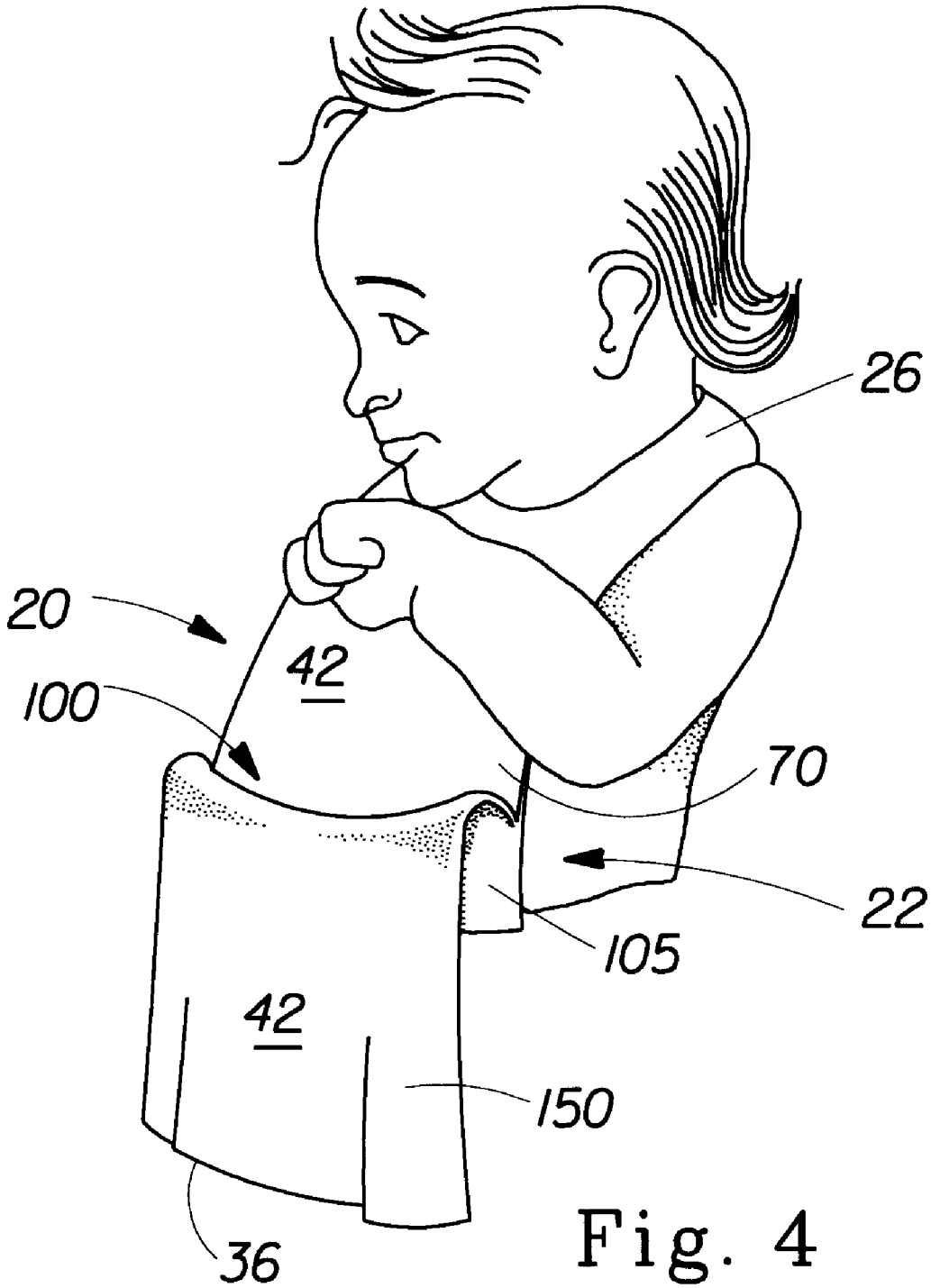
FIG. 4 is an in use perspective view of a disposable bib according to the present invention.

The bib 20 can also include a pocket 100 extending substantially the full lateral width of the bib 20 for catching and receiving food particles. Referring to FIG. 4, the bib body 22 can comprise a body panel 70, a pocket panel 105, and an apron panel 150. The body panel 70 can be separated from the pocket panel 105 by a laterally extending fold in the bib body, and the pocket panel 105 can be separated from the apron panel 150 by another parallel laterally extending fold in the bib body. U.S. Pat. No. 4,445,231 "Bib Having Gravitationally Openable Pocket" issued May 1, 1984 to Noel is incorporated herein by reference for the purpose of showing a bib construction for forming a bib having a pocket and an apron panel.

The bib 20 also preferably comprises a fastening assembly for joining together the shoulder extensions 24 and 26 in an overlapping fashion, to thereby secure the bib 20 to the wearer. The fastening assembly can comprise a mechanical fastener having elements disposed on at least one of the shoulder extensions, which elements penetrate and physically engage a landing surface on the other shoulder extension. In one embodiment, the fastener can comprise an array 305 of projections 312 extending from a portion of the shoulder extension 26. The projections 312 are engagable with a landing surface, the landing surface being disposed on at least a portion of the shoulder extension 24.

In one embodiment, the projections 312 can comprise prongs, and the landing surface can comprise a target surface of a nonwoven web disposed on the shoulder extension 24. The nonwoven web having the surface 350 can be adhesively joined to the backsheet 80 on an upper portion 43 which includes shoulder extensions 24 and 26. A nonwoven web disposed on both the shoulder extensions 24, 26 can provide a soft, nonabrasive surface about the wearer's neck.

Referring to the components of the bib 20 in more detail, the bib 20 according to one embodiment of the present invention comprises a composite construction having multiple laminae. The bib body 22 comprises a laminate of a first layer, such as an absorbent outer topsheet layer 40, and a second layer, such as a body facing backsheet layer 80 which is liquid impermeable relative to the topsheet 40. The topsheet 40 has an outer surface 42 for receiving spilled food material. The backsheet 80 has a body facing surface 82 shown in FIG. 2. The layer 40 and the layer 80 can be joined together, such as with an adhesive, to form a laminate.

The topsheet 40 can comprise a paper web having a basis weight of from about 10 to about 50 pounds per three thousand square feet. The following U.S. Patents are incorporated by reference for the purpose of disclosing how to make tissue paper suitable for use in making a topsheet 40: U.S. Pat. Nos. 4,191,609; 4,529,480; 4,637,859; 5,223,096; and 5,240,562. A suitable topsheet 40 can be formed from a single ply or multiple ply paper towel. In one embodiment, the topsheet 40 comprises a two ply Bounty Paper Towel manufactured by The Procter and Gamble Company of Cincinnati, Ohio.

The backsheet 80 can comprise a liquid impervious polymeric film, such as a polyolefinic film. In one embodiment the backsheet 80 can comprise a polyethylene film having a thickness of between about 0.3 mil and about 4.0 mil (about 0.0003 inch to about 0.0040 inch). In one embodiment the backsheet can comprise a FS-II embossed Polyethylene film having a thickness of about 2.0 mil and manufactured under the designation CPC-2 by Tredegar Film Products of Richmond, Va.

The topsheet 40 can be joined to the backsheet 80 in any suitable manner, including but not limited to methods such as adhesive bonding, mechanical bonding, and ultrasonic bonding. A suitable adhesive for joining the topsheet 40 and the backsheet 80 is a hot melt adhesive such as a hot melt pressure sensitive adhesive. Suitable adhesives include HL-1258 and HL 1262 adhesives manufactured by H. B. Fuller Co. of St. Paul, Minn.

The target surface 350 can comprise the surface of a nonwoven web of fibers disposed on the backsheet 80 of the upper portion 43 of the bib 20. In the embodiment shown in FIG. 1, the target surface 350 extends over entire upper surface which includes shoulder extensions 24 and 26. A suitable nonwoven web is manufactured by the Fiberweb Corp. of Simpsonville, S.C. under the designation Celestra Unicorn.

Alternatively, such a nonwoven web can extend over substantially all of the paper layer 40 such that the shoulder extensions 24, 26, the bib body panel 70, the pocket panel 105, and the apron panel 150 are formed from a single, continuous sheet of a laminate of at least three layers: the backsheet 80, the paper layer 40, and the nonwoven web, with the paper layer 40 disposed between the backsheet 80 and the nonwoven web.

Prior to the time the bib is to be used, the shoulder extensions 24 and 26 can be joined together, such as at their distal ends, along a selective line of weakening 270. When the bib is to be used, the shoulder extensions are separable along the selective line of weakening 270, such that the shoulder extensions can be separated without tearing or otherwise damaging other portions of the bib, and releasably joined together in an overlapping fashion by the fastening assembly.

In one embodiment, the selective line of weakening 270 is aligned with the longitudinal centerline 21, and comprises a plurality of spaced apart perforations 271. The perforations 271 can extend partially or fully through the thickness of the bib 20. The perforations can be formed with a perforating knife, and can extend through each of the backsheet 80, topsheet 40, and nonwoven web.

Figure 3:
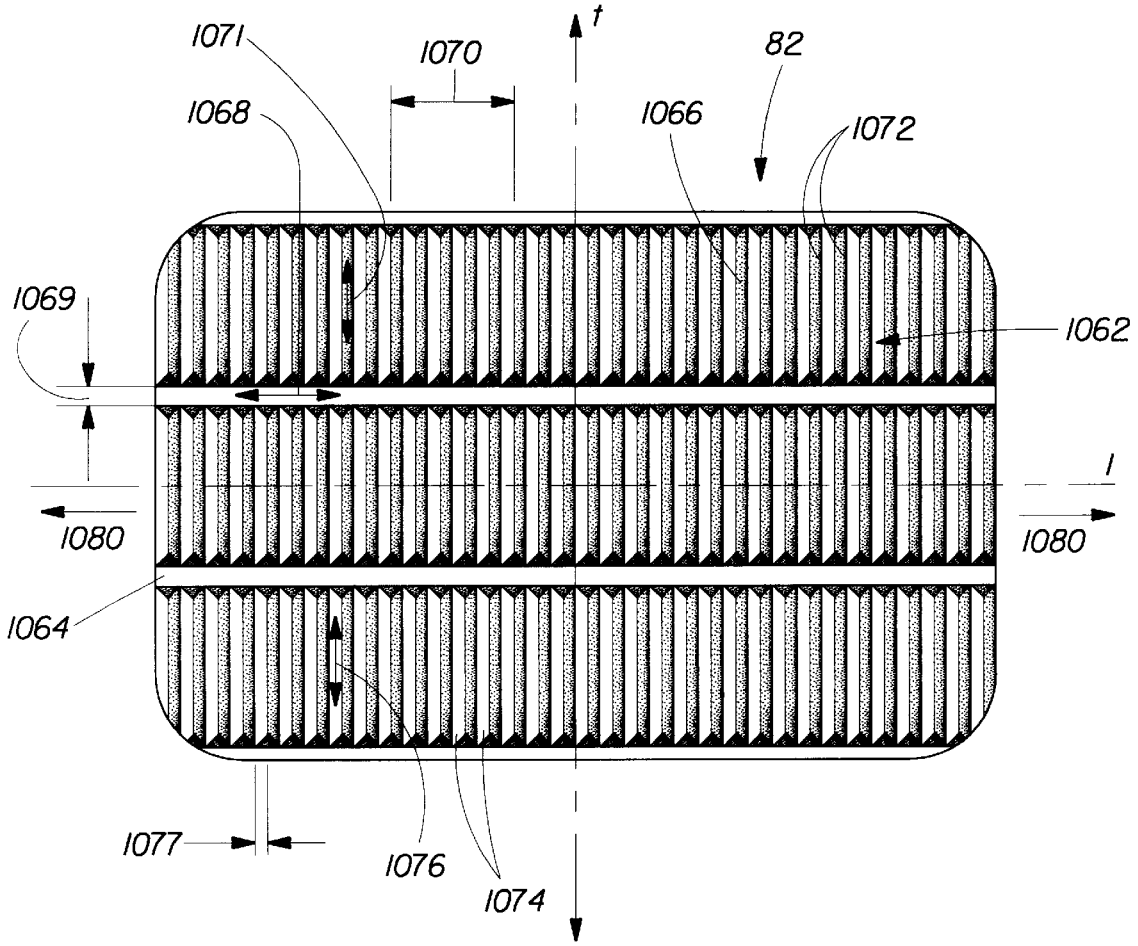
FIG. 3 is enlarged view of a typical strainable network similar to the strainable network portrayed in the area surrounding the neck opening of the disposable bib in FIGS. 1 and 2.

In the embodiment shown in FIG. 1, the area 500 surrounding the perimeter of the neck opening 200 is permanently elongated to provide a strainable network. An enlarged view of the strainable network is shown in FIG. 3. Such a strainable network is disclosed in U.S. Pat. No. 5,518,801 issued May 21, 1996 to Chappell et al., which patent is incorporated by reference herein. The strainable network provides elastic like behavior of the laminate along at least one axis, as disclosed in above referenced U.S. Pat. No. 5,518,801. The strainable network can be formed by permanently elongating portions of the bib using the apparatus shown in FIGS. 10–12, as described more fully below.

The term "strainable network"refers to an interconnected and interrelated group of regions which are able to be extended to some useful degree in a predetermined direction for providing a component with an elastic-like behavior.

The strainable network includes one or more first regions and one or more second regions. The first regions can undergo a substantially molecular level deformation, or a combination of molecular level deformation and geometric deformation in response to an subsequently applied elongation, such as an elongation applied to the neck opening once the strainable network is formed. The second regions initially undergo a substantially geometric deformation in response to a subsequently applied elongation, such as an elongation applied to the neck opening once the strainable network is formed.

The term "molecular level deformation" refers to deformation which occurs on a molecular level and is not discernible to the normal naked eye, such that even though one may be able to discern the effect of the molecular level deformation (e.g. elongation of a component), one is not able to discern the deformation which allows or causes the elongation. This is in contrast to "geometric deformation". The term "geometric deformation" refers to deformations which are discernible to the normal naked eye. "Geometric deformation" includes, but is not limited to, bending, unfolding, and rotating.

Referring to FIG. 3, the strainable network 1062 includes a plurality of first regions 1064 and a plurality of second regions 1066. The first regions 1064 have a first axis 1068 and a second axis 1069, wherein the first axis 1068 is longer than the second axis 1069. The first axis 1068 is substantially parallel to a longitudinal axis 1 of the network, and the second axis 1069 is substantially parallel to a transverse axis t of the network. The second regions 1066 have a first axis 1070 and a second axis 1071. The first axis 1070 is substantially parallel to the axis 1 of the network, and the second axis 1071 is substantially parallel to the axis t of the network.

In the embodiment shown in FIG. 3, the first regions 1064 are substantially planar. The second regions 1066 include a plurality of rib-like elements 1074. The rib-like elements 1074 have a first major axis 1076 which is substantially parallel to the axis t of the network, and a second minor axis 1077 which is substantially parallel to the axis 1 of the network. The rib-like elements 1074 extend outward from surrounding portions of the strainable network (toward the viewer in FIG. 3) to form ridges 1072. Valleys corresponding to the ridges 1072 form depressions in the laminated surface of the bib.

Referring to FIG. 3, when an elongation (indicated by arrows 1080) is applied to the strainable network generally parallel to axis 1, the rib-like elements 1074 are able to unbend or geometrically deform in a direction substantially perpendicular to their first axis 1076, thereby allowing elastic like extension of the strainable network generally parallel to the axis 1.

The first region 1064 and the second region 1066 each have a projected pathlength and a surface pathlength. The available elastic like extension or stretch of the strainable network is determined by the surface pathlength of the second region 1066 relative to the surface pathlength of the first region 1064 for a given projected pathlength.

Projected pathlength refers to the length of a shadow of a region measured parallel to the longitudinal axis 1 that would be thrown by parallel light. The projected pathlength of the first region is equal to the projected pathlength of an adjacent second region.

Surface pathlength is the length of the outermost region measured topographically in a direction parallel to the longitudinal axis 1 of the strainable network. Since the second region is typically comprised of rib-like elements where as the first region is typically planar, the surface pathlength of the second region exceeds the surface pathlength of the first region for each corresponding projected surface pathlength.

The surface pathlength of the second region is determined at least in part by the rib-like element spacing, rib-like element frequency, and the depth of formation of the rib-like elements measured in the Z-direction of the bib. In general, the greater the surface-pathlength of the second region, the greater the available stretch of the web material.

The available stretch within the second region may be varied along the longitudinal axis 1 of the strainable network by dividing a second region into zones and providing each zone with rib-like elements having different surface pathlengths. Similarly, the available stretch may be varied along the transverse axis t of the strainable network by providing adjacent second regions with rib-like elements having different surface pathlengths.

Figure 2:
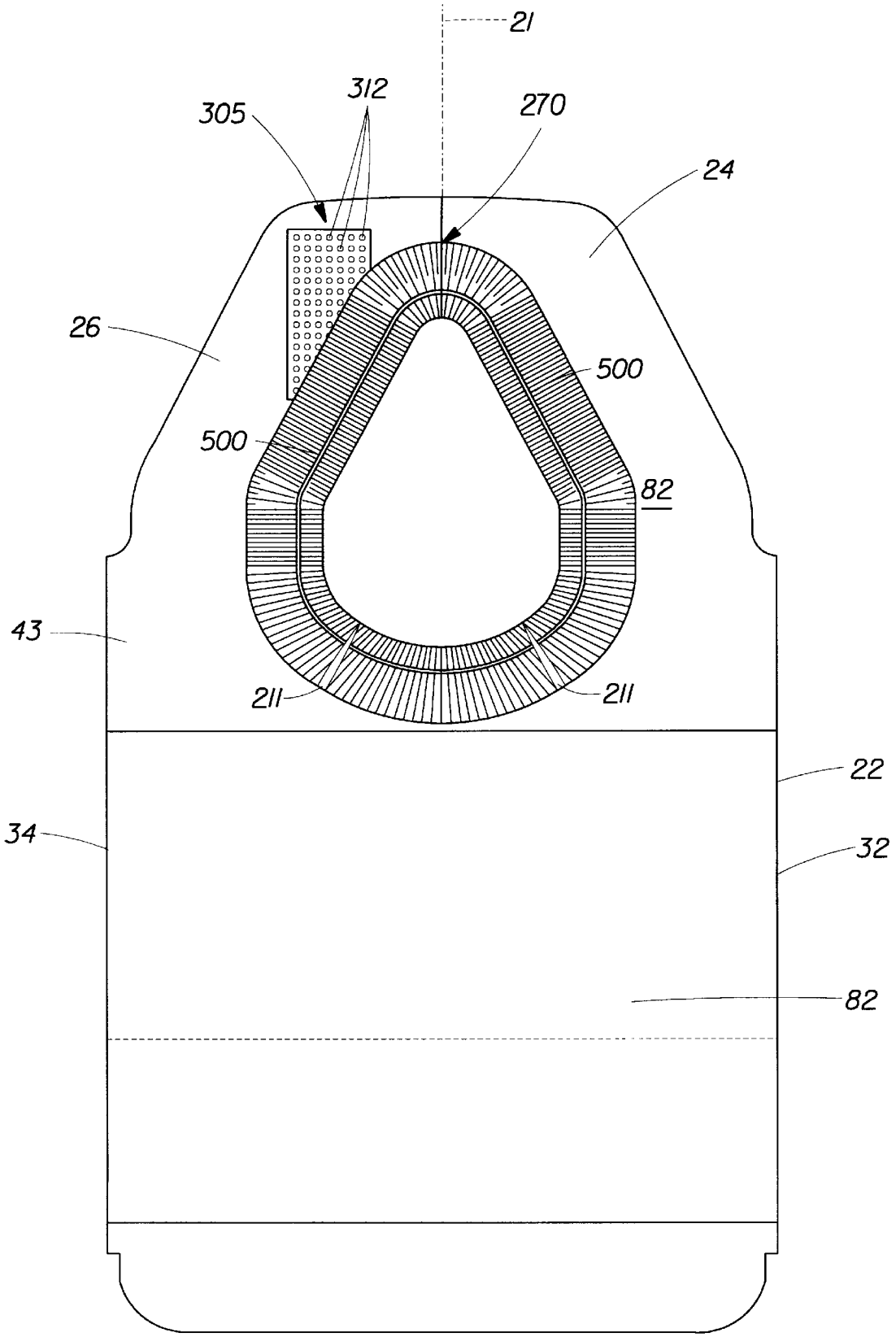
FIG. 2 is a rear plan view of a disposable bib of the present invention.

In FIGS. 1 and 2, the strainable network is juxtaposed with and preferably circumjacent the neck opening on the laminate of the layers 350 and 80. As shown enlarged in FIG. 5, the orientation is such that the major axis 1076 of each rib-like element 1074 is generally orthogonal to the perimeter of the neck opening 200 and the first axis 1068 of the planar first region is oriented parallel to the perimeter of the neck opening 200. Accordingly, the strainable network provides elastic like behavior of the laminate of the layers 350 and 80 in at least the circumferential direction around the neck opening. Accordingly, the neck opening 200 can be elastically extended in a direction around the wearer's neck.

Figure 5:
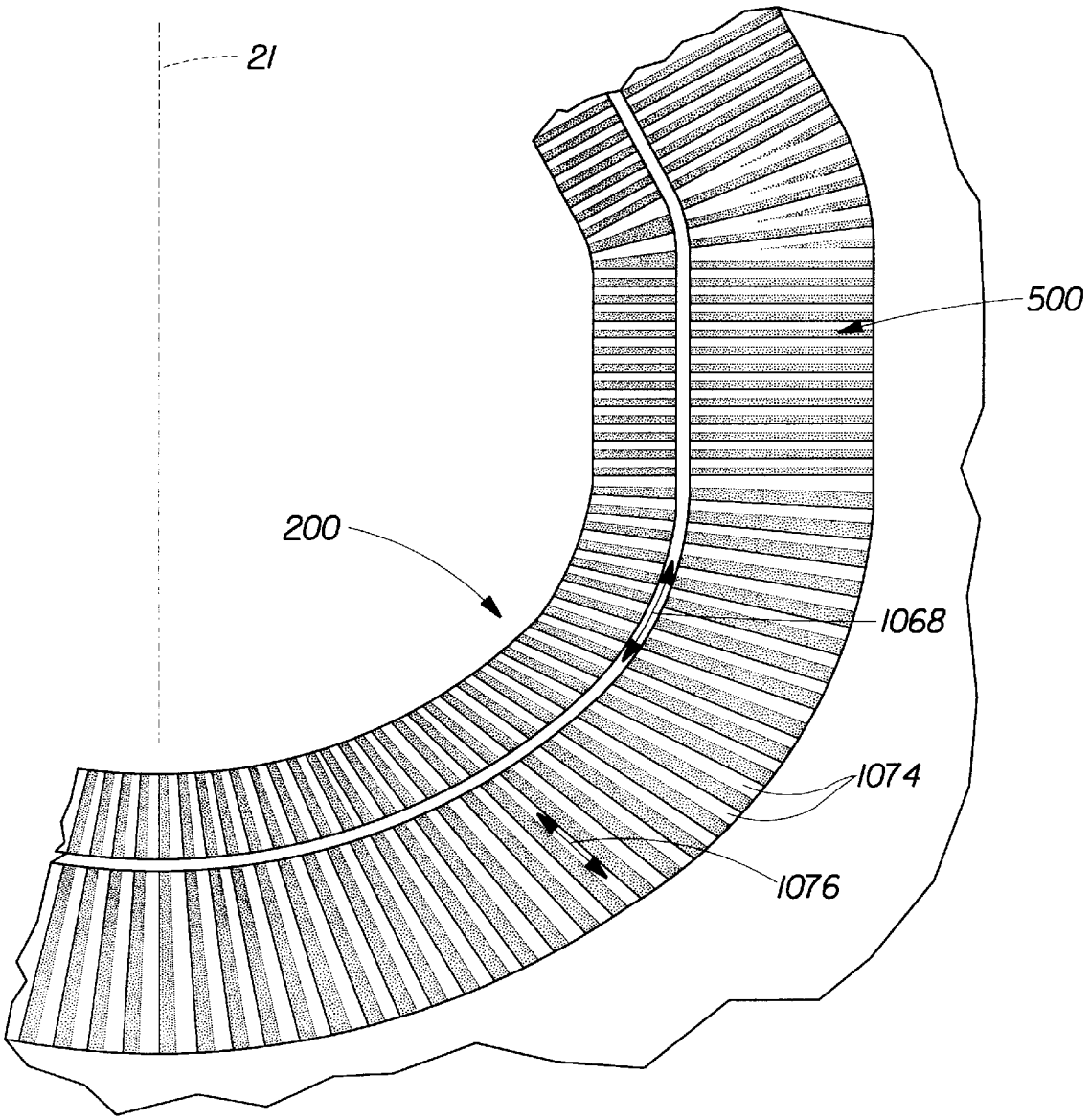
FIG. 5 is an enlarged view of the strainable network surrounding the neck opening in FIGS. 1 and 2, illustrating an embodiment where the planar first region extends parallel to the perimeter of the neck opening and the raised rib-like elements of the second region lie orthogonal to the perimeter of the neck opening.

The elastic behavior of the strainable network as applied to the laminated structure shown in FIG. 5 results in an elasticity of at least about 10 percent elongation, preferably about 10 to about 50 percent elongation, and more preferably between about 15 percent and about 35 percent elongation.

Figure 6:
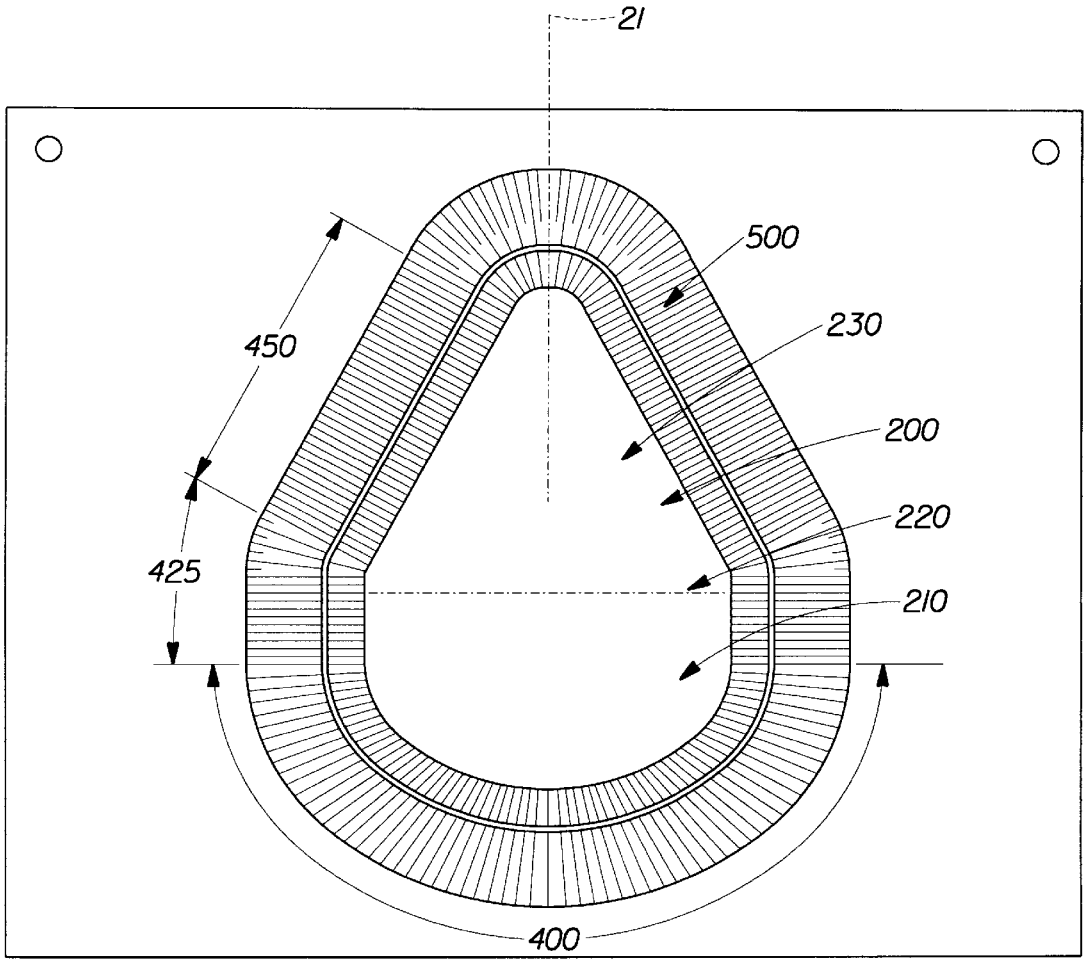
FIG. 6 is a view of the strainable network surrounding the neck opening of FIGS. 1 and 2, illustrating an alternate embodiment where the front portion, the maximum width portion and the rear portion of the neck opening each include second regions having different surface pathlengths for different corresponding levels of extensibility.

In an alternative embodiment shown in FIG. 6, the area surrounding the perimeter of the neck opening 200 has an available stretch which varies among a front neck area 400, a maximum width area 425 and a rear neck area 450. In this configuration, available stretch for each of the areas is determined based on the resulting comfort provided to the wearer. This is accomplished by providing a continuous second region circumscribing the perimeter of the neck opening 200 having the rib-like elements 1074 oriented orthogonal to the perimeter and varying the pathlengths of the rib-like elements 1074 for each portion of the neck opening 200. One possible arrangement of which there are several, comprises the maximum width area 425 having a surface pathlength exceeding the surface pathlength of the front neck area 400, and the rear neck area 450 having a surface pathlength exceeding the surface pathlengths of both the maximum width and the front neck areas 425, 400.

One skilled in the art can appreciate that there are multiple ways of orienting the first and second regions in the area surrounding the perimeter of the neck opening to accomplish a desirable available stretch or other requirement. A typical requirement involves accommodating machining direction used during manufacturing. For instance, it may be desirable to orient the raised rib-like elements parallel to the machining direction in order to facilitate the manufacturing of the bibs.

Figure 7:
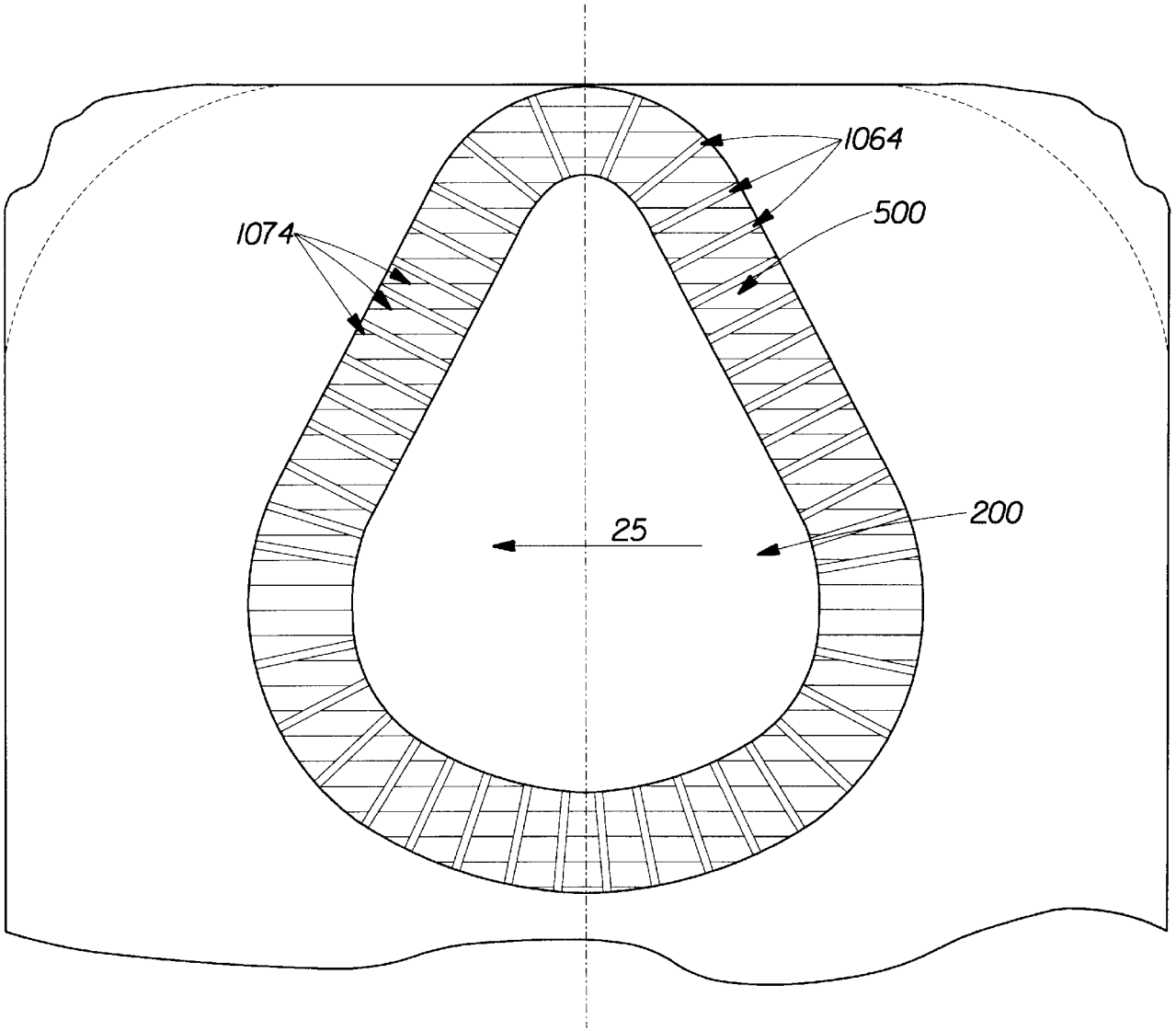
FIG. 7 is a view of the strainable network surrounding the neck opening in FIGS. 1 and 2, illustrating an embodiment having a plurality of planar first regions extending orthogonal to the perimeter of the neck opening and the raised rib-like elements of the second region positioned orthogonal to the longitudinal centerline of the bib.

In an alternate embodiment shown in FIG. 7, the raised rib-like elements are oriented parallel to the machining direction 25 which is parallel to the transverse axis of the bib. For this embodiment, the corresponding planar first regions are oriented orthogonal to the perimeter of the neck opening 200.

Figure 8:
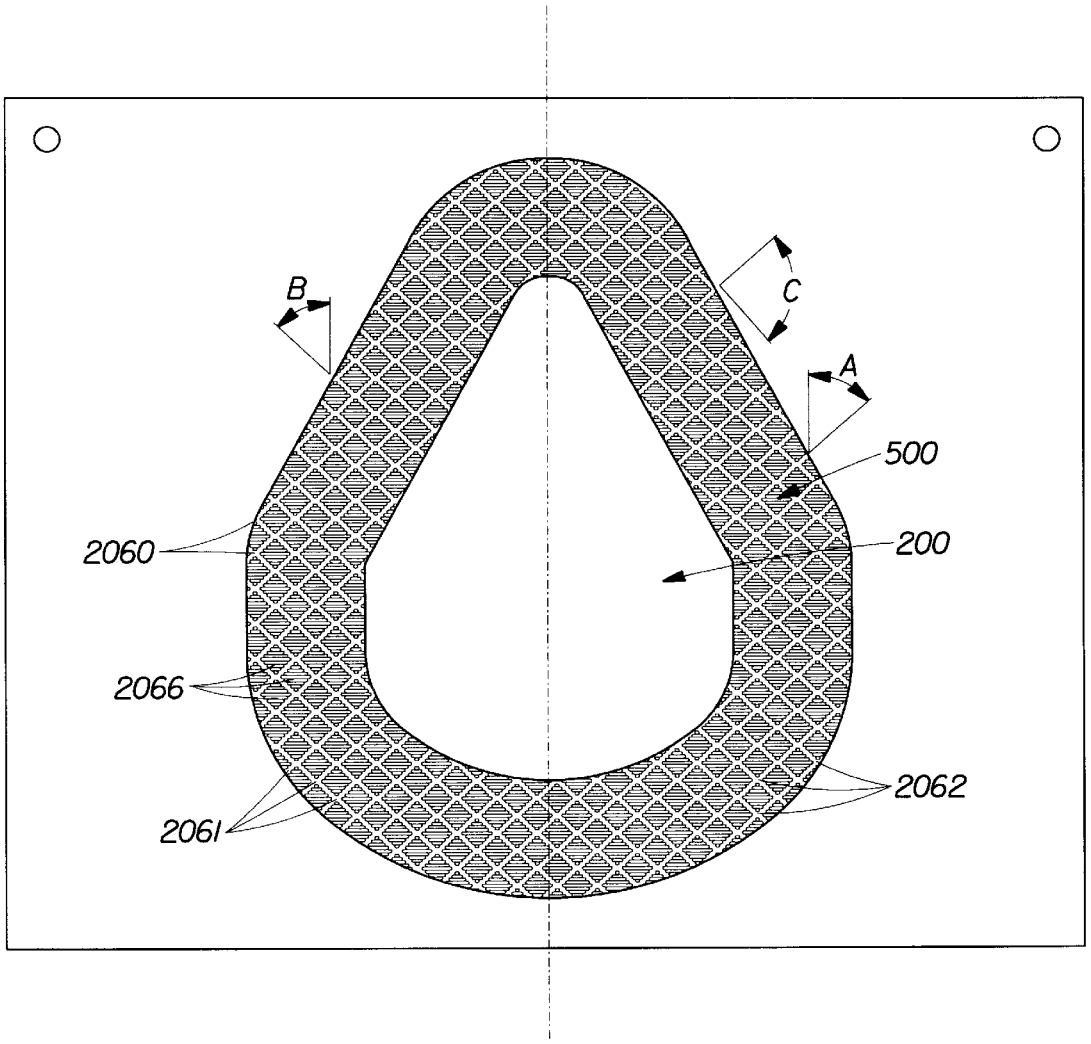
FIG. 8 is a view of the strainable network surrounding the neck opening of FIGS. 1 and 2 according to an alternative embodiment of the present invention, wherein the disposable bib includes a strainable network having mutually perpendicular, intersecting first regions extending along first and second directions which are inclined at about a 45 degree angle with respect to the longitudinal centerline of the bib, and second regions comprising rib-like elements, each rib-like element having a major axis extending perpendicular to the longitudinal centerline of the bib.
Figure 9:
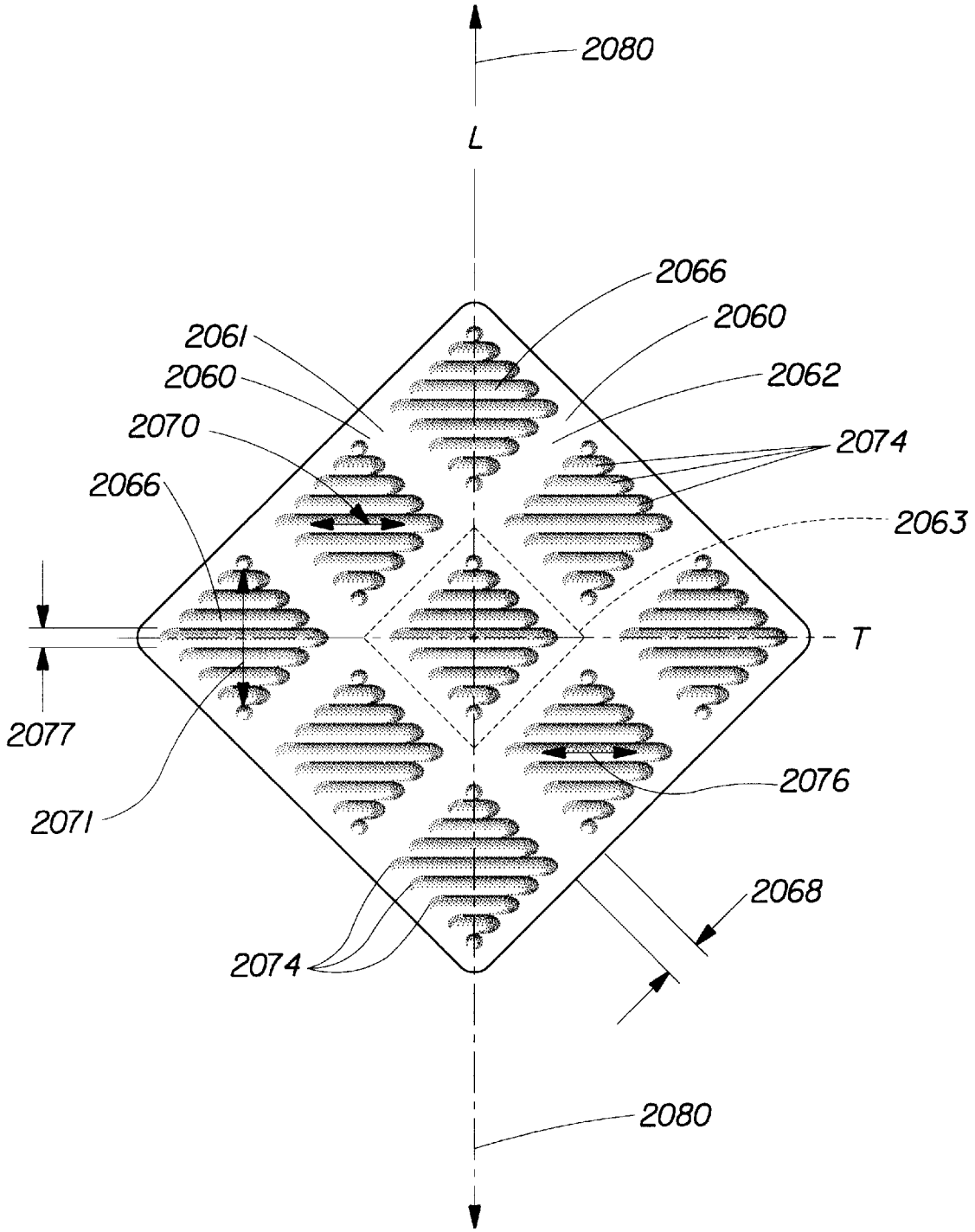
FIG. 9 is enlarged view of a portion of a strainable network of the type illustrated in FIG. 8 showing the first regions forming a boundary completely surrounding the second regions.

Referring to FIGS. 8 and 9, according to an alternative embodiment of the present invention, the area 500 surrounding the perimeter of the neck opening 200 can comprise a strainable network which includes a plurality of first regions, indicated by reference numeral 2060 in FIG. 8, and a plurality of second regions, indicated by reference numeral 2066. A portion of the first regions 2060, indicated generally as 2061, are substantially linear and extend in a first direction. The remaining first regions 2060, indicated generally as 2062, are substantially linear and extend in a second direction which is different from the first direction. Such a strainable network is described generally in commonly assigned U.S. Pat. No. 5,650,214 issued Jul. 22, 1997 in the names of Anderson et al., which patent is incorporated herein by reference.

The first regions 2061 can have a first principal direction which is inclined clockwise from the longitudinal centerline 21 at an angle A (FIG. 8). The angle A can be between about 30 degrees and about 60 degrees. The first regions 2062 can extend in a second principal direction which is inclined counterclockwise from the longitudinal centerline 21 at an angle B with respect to the longitudinal centerline 21. The angle B can be between about 30 and about 60 degrees. In the embodiment shown in FIG. 8, the angles A and B can both be about 45 degrees. Two angles are formed by the intersection of the first and second principal directions of the first regions wherein at least one of the angles, designated as angle C (FIG. 8), is between 45 and 135 degrees.

In the embodiment shown in FIG. 8, the first and second directions are substantially perpendicular to one another yielding an inclined angle C of 90 degrees. The intersection of the first regions 2061 with the first regions 2062 forms a boundary, indicated by phantom line 2063 in FIG. 9, which completely surrounds the second regions 2066.

The strainable network is shown on the area 500 surrounding the perimeter of the neck opening 200 facing the viewer in FIG. 8. It will be understood that the strainable network can cover some or all of the body panel 70. For instance, the strainable network can extend over a portion of all of the shoulder extensions 24, 26, or alternatively can be omitted from the shoulder extensions 24, 26 (excluding the area surrounding the perimeter of the neck opening).

The strainable network shown in FIG. 9 is viewed from the body facing surface 82 of the bib 20. Referring to FIG. 9, the second regions 2066 include a plurality of raised, rib-like elements 2074. The rib-like elements 2074 extend outward from surrounding portions of the strainable network (toward the viewer in FIG. 9) to form ridges in the body facing surface 82. Valleys corresponding to the ridges form depressions in the surface 42.

As shown in FIG. 9, the strainable network has an axis L and a mutually perpendicular axis T. In FIG. 8, the axis L of the strainable network is substantially parallel to the longitudinal centerline 21 of the bib.

The width 2068 of the first regions 2060 can be from about 0.01 inch to about 0.5 inch. In one embodiment, the width 2068 is about 0.030 inch.

The second regions 2066 have a first axis 2070 and a second axis 2071. The first axis 2070 is substantially parallel to the axis T, and the second axis is substantially parallel to the axis L. The rib-like elements 2074 may be embossed, debossed, or a combination thereof. The rib-like elements have a first or major axis 2076 and a second or minor axis 2077. In FIG. 8, the major axis 2076 of the rib-like elements 2074 is substantially perpendicular to the longitudinal centerline 21 of the bib 20.

When the strainable network of the type shown in FIG. 9 is subjected to an applied elongation (indicated by arrows 2080 in FIG. 9) along an axis, the first regions 2061 and 2062 provide most of the initial resistive force as a result of molecular level deformation, while the second regions 2066 are experiencing geometric deformation. In addition, the shape of the second regions 2066 changes as a result of the movement of the reticulated structure formed by the intersecting first regions 2061 and 2062. Accordingly, as the strainable network is subjected to the elongation, the first regions 2061 and 2062 experience geometric deformation, thereby changing the shape of the second regions. The second regions 2066 are extended or lengthened in a direction parallel to the direction of the applied elongation, and are foreshortened in a direction perpendicular to the direction of the applied elongation. This characteristic of the strainable network shown in FIG. 9 is described in above referenced U.S. Pat. No. 5,650,214.

Figure 10:
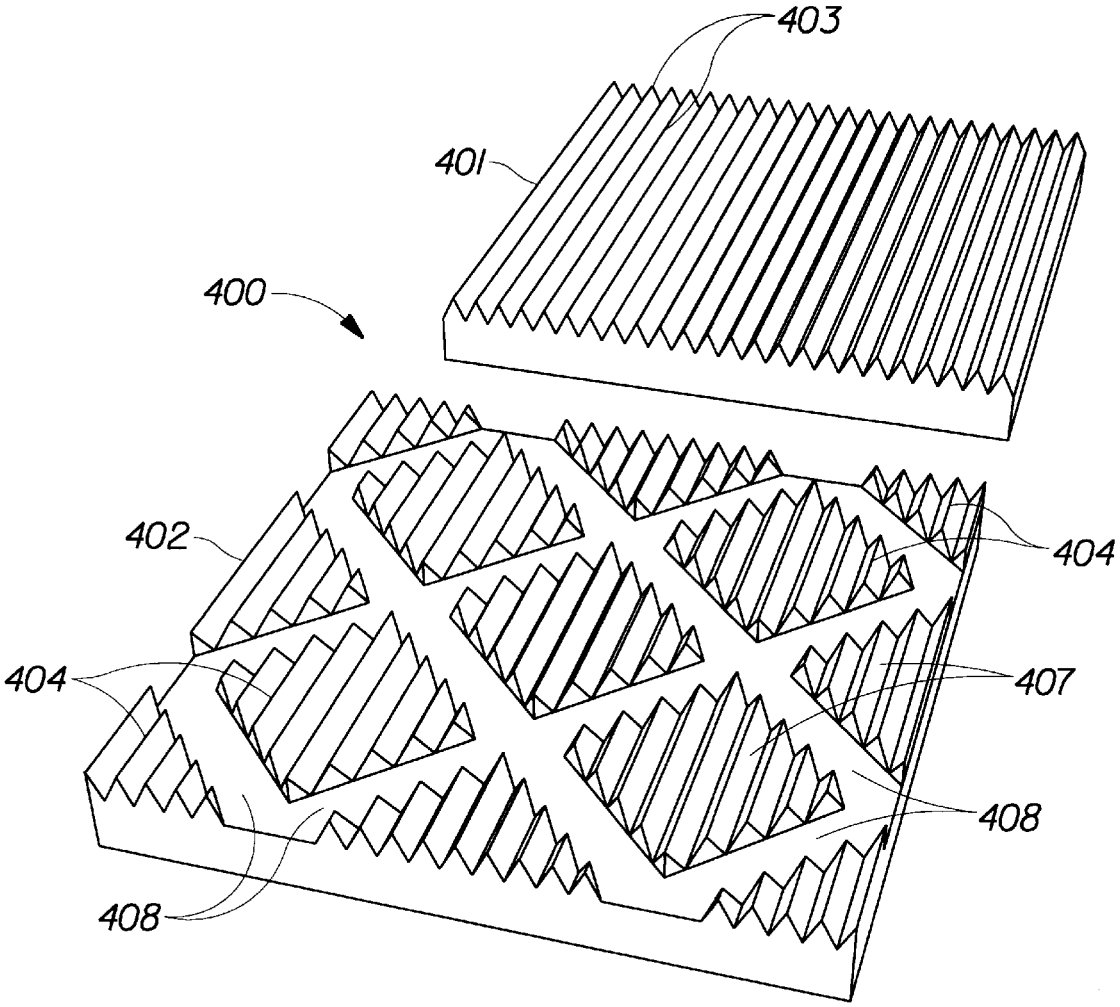
FIG. 10 is a schematic perspective illustration of a toothed apparatus used to form the strainable network shown in FIG. 9.
Figure 11:
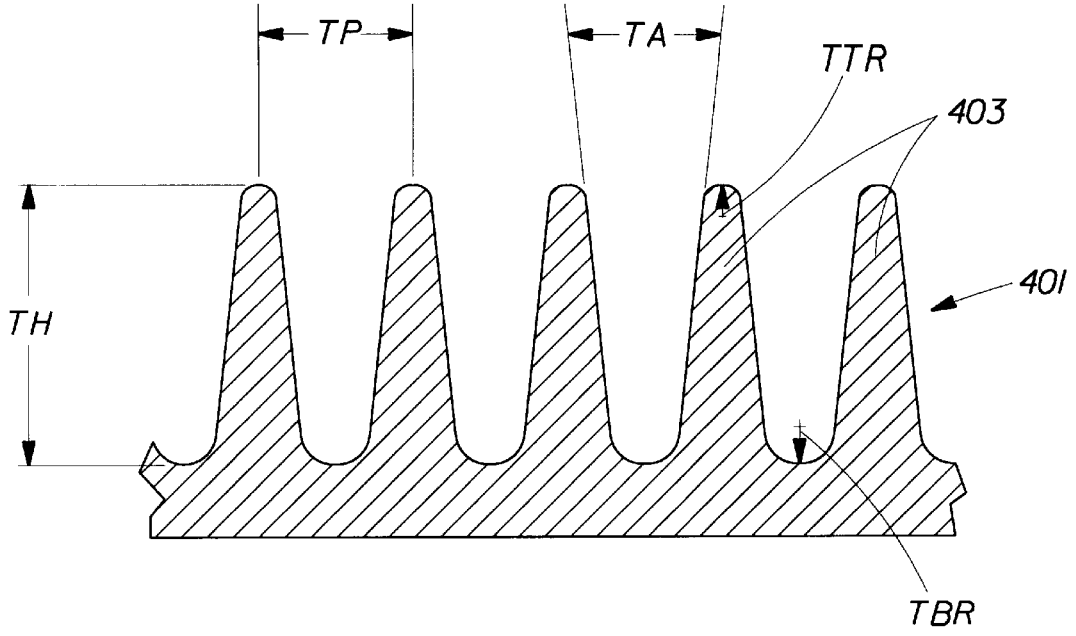
FIG. 11 is a cross-sectional illustration of a portion of the apparatus of FIG. 10.
Figure 12:
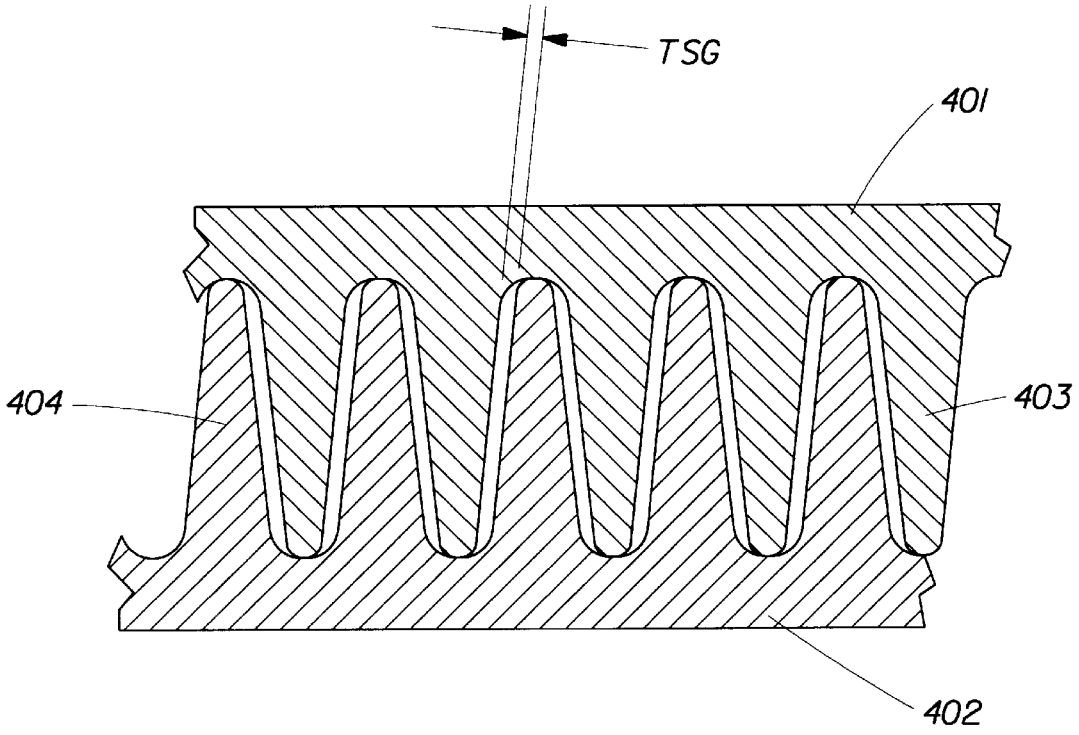
FIG. 12 is a cross-sectional illustration of the apparatus of FIG. 10 showing engagement of the teeth used to form the strainable network.

FIG. 10 shows a toothed apparatus 400 which can be used to permanently elongate portions of the bib and thereby form the strainable network shown in FIG. 9. FIG. 11 is a cross-sectional illustration of a portion of the apparatus of FIG. 10. FIG. 12 is a cross-sectional illustration of the apparatus of FIG. 10 showing engagement of the teeth used to form the strainable network.

Referring to FIG. 10, the apparatus 400 includes intermeshing plates 401 and 402. Plates 401 and 402 include a plurality of intermeshing teeth 403,404, respectively. The strainable network is formed by placing the bib laminate between the plates 401 and 402, and bringing the plates 401,402 together under loading to form the strainable network. Preferably, the nonwoven target surface 350 is positioned against the plate 402 and the backsheet 80 is positioned against the plate 401.

Plate 402 includes toothed regions 407 and grooved region 408. Within the toothed regions 407 there are a plurality of teeth 404. Plate 401 includes teeth 403 which mesh with teeth 404 of plate 402. When a substrate, such as a laminate of nonwoven target surface 350 and backsheet 80, is formed between plates 401, 402, the portions of the substrate which are positioned between grooved regions 408 of plate 402 and teeth 403 on plate 401 remain undeformed. These regions correspond to the first regions 2060. The portions of the substrate positioned between toothed regions 407 of plate 402 and teeth 403 of plate 401 are permanently elongated, creating rib-like elements 2074 in the second regions 2066.

The plate 401 is shown in cross-section in FIG. 11. The teeth 401 (and the teeth 404 on plate 402) can have the following characteristics to form a strainable network in the laminate comprising the paper topsheet 40 and the plastic film backsheet 80: The tooth height TH can be about 0.0800 inch, the tooth pitch TP can be about 0.0400 inch, the tooth angle TA can be about 11.31 degrees, the tooth tip radius TTR can be about 0.0040 inch, and the tooth base radius TBR can be about 0.0093 inch.

FIG. 12 shows intermeshing of the plates 401 and 402 without a substrate positioned between the plates. The plates 401 and 402 can intermesh to have a tooth side gap TSG of about 0.0048 inch, as shown in FIG. 12.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A disposable bib having a longitudinal centerline, a lateral width and longitudinally extending side edges, said bib comprising a bib body; and a pair of shoulder extensions extending from the bib body to provide a generally planar neck opening having a perimeter and an area surrounding the perimeter; wherein the area surrounding the perimeter is permanently elongated such that said neck opening has circumferential extensibility and elasticity.

2. The disposable bib of claim 1, wherein said generally planar neck opening has a longitudinal length and said neck opening further comprises a front neck portion, a rear neck portion, and a maximum width portion interposed between the front and rear neck portions, and wherein said neck opening is generally symmetric about a longitudinal axis and generally asymmetric about a lateral axis passing through the midpoint of the longitudinal length of said neck opening.

3. The disposable bib of claim 2, wherein the maximum width portion is defined by two parallel side edges.

4. The disposable bib of claim 3, wherein the two parallel side edges are parallel to the longitudinally extending side edges.

5. The disposable bib of claim 2, wherein the rear neck portion has a longitudinal length which is at least 1.5 times the longitudinal length of the front neck portion.

6. The disposable bib of claim 2, wherein the bib body further comprises a plurality of slits extending from the front neck portion of said neck opening.

7. The disposable bib of claim 2, wherein the area surrounding the perimeter of said neck opening includes a strainable network comprising at least one first region and at least two second regions, the first region undergoing a substantially molecular level deformation and the second regions initially undergoing a substantially geometric deformation when the perimeter of said neck opening is subjected to an applied elongation.

8. The disposable bib of claim 7, wherein the first region is substantially planar and the second regions comprise a plurality of raised rib-like elements.

9. The disposable bib of claim 8, wherein the raised rib-like elements extend generally orthogonal relative to the perimeter of said neck opening.

10. The disposable bib of claim 8, wherein the planar first region extends parallel relative to the perimeter of said neck opening.

11. The disposable bib of claim 7, wherein the first region and the second regions have surface-pathlengths and wherein the surface-pathlength of the second regions is greater than the surface-pathlength of the first region.

12. The disposable bib of claim 11, wherein the surface-pathlength of at least one second region in the area surrounding the perimeter in the maximum width portion of said neck opening is greater than the surface-pathlength of at least one second region in the area surrounding the perimeter in the front portion of said neck opening.

13. The disposable bib of claim 12, wherein the surface-pathlength of at least one second region in the area surrounding the perimeter in the rear portion of said neck opening is greater than the surface-pathlength of at least one second region in the area surrounding the perimeter in the maximum width portion of said neck opening.

14. A disposable bib having a longitudinal centerline, a lateral width and longitudinally extending side edges, said bib comprising a bib body; and a pair of shoulder extensions extending from the bib body to provide a generally planar neck opening having a perimeter and an area surrounding the perimeter; wherein the area surrounding the perimeter of said neck opening includes a strainable network comprising at least one substantially planar first region and at least two second regions comprising a plurality of raised rib-like elements, the first region undergoing a substantially molecular level deformation and the second regions initially undergoing a substantially geometric deformation when the perimeter of said neck opening is subjected to an applied elongation.

15. The disposable bib of claim 14, wherein the raised rib-like elements are oriented orthogonal to the longitudinal centerline.

16. The disposable bib of claim 15, further comprising a plurality of substantially planar first regions oriented generally orthogonal to the perimeter of said neck opening.

17. The disposable bib of claim 14, wherein the raised rib-like elements are oriented generally orthogonal to the perimeter of said neck opening.

18. The disposable bib of claim 17, wherein the at least one planar first region is oriented parallel to the perimeter of said neck opening.

* * * * *